United States Patent [19]

Genuardi

[11] 4,097,191

[45] Jun. 27, 1978

[54] OUTBOARD HUB

[75] Inventor: Bennie Genuardi, Tampa, Fla.

[73] Assignee: Irving Navarre, Tampa, Fla.

[21] Appl. No.: 780,770

[22] Filed: Mar. 24, 1977

[51] Int. Cl.[2] ..... B63H 1/20

[52] U.S. Cl. ..... 416/170 R; 416/62; 416/244 B

[58] Field of Search ..... 416/244 B, 245 A, 62, 416/146, 170 R

[56] References Cited

U.S. PATENT DOCUMENTS

| | | | |
|---|---|---|---|
| 2,327,453 | 8/1943 | Presser | 416/244 B |
| 2,495,116 | 1/1950 | McClain | 416/62 |
| 2,856,213 | 10/1958 | Hutchinson | 416/244 B X |
| 3,299,964 | 1/1967 | Foster | 416/244 B X |
| 3,698,836 | 10/1972 | Herbage | 416/244 B X |
| 3,732,033 | 5/1973 | Macchi | 416/244 B |
| 3,981,165 | 9/1976 | Wersinger | 416/146 R X |
| 4,021,143 | 5/1977 | May | 416/244 B X |

FOREIGN PATENT DOCUMENTS

| | | | |
|---|---|---|---|
| 463,583 | 5/1975 | U.S.S.R. | 416/244 B |

*Primary Examiner*—Everette A. Powell, Jr.

*Attorney, Agent, or Firm*—Duckworth, Hobby, Allen & Pettis

[57] ABSTRACT

An auxiliary hub device for use in combination with a propeller of an outboard drive marine engine, the device basically comprising a sleeve which is attachable in interconnecting relation between the engine's drive shaft and the outboard propeller. The auxiliary hub device is used as an emergency connector so as to enable an outboard drive marine engine whose propeller has sheared from the drive shaft to make way in the water.

10 Claims, 6 Drawing Figures

OUTBOARD HUB

BACKGROUND OF THE INVENTION

1. Field of the Invention

The present invention relates to an auxiliary hub device intended to be used in affecting an emergency repair to an outboard drive marine engine whose propeller has sheared from its drive shaft. The auxiliary hub device basically comprises sleeve means which may be placed in interconnecting relationship between the drive shaft and the propeller, whereby power will be transmitted to the propeller.

2. Description of the Prior Art

Various constructions are well known in the prior art for outboard drive marine engines. With such devices, a drive shaft normally extends outwardly from the stern of the boat, and a propeller, or screw, is fixed thereto. As the drive shaft rotates, the propeller forces the boat through the water. While there are various specific configurations for attaching the propeller to the drive shaft, they all basically comprise some mechanical fastening means such as a bolt or pin for this purpose. However, by virtue of the fact that the propeller itself is exposed to any submerged item with which it might come into contact, any fisherman or boating enthusiast is aware of the fact that the propeller may be sheared, or broken free from the drive shaft. This, of course, will immobilize the boat.

In recognition of this problem, numerous devices have been designed and constructed for the specific purpose of protecting the outboard propeller and/or its drive shaft. One such device is disclosed in U.S. Pat. No. 2,143,693 to Harris. The invention disclosed therein relates to a sleeve which is disposed around the drive shaft to prevent its being damaged as by entanglement with a rope or line. Additionally, various devices are known for attachment to outboard propellers, not specifically for the purpose of protecting the propeller, but rather for reducing its thrust so that the boat may be used for trolling. Again, while the specific purpose of such devices is to reduce the power developed by the propeller, some protection is also provided. Devices of this type are shown in U.S. Pat. Nos. 1,908,865 and 2,226,007. It should be noted, however, that none of these type devices will serve to repair a propeller which has sheared, or broken free, from its corresponding drive shaft.

Accordingly, it is clear that there is a great need in the art for some device which will at least temporarily reconnect a propeller to its drive shaft so that the boat may be brought back into port. Such a device should be of relatively small size so that it could be conveniently carried in the boat and handled by a single person. Additionally, it would be desirable if the device could be operatively attached using a minimum variety of tools and wrenches.

Of course, such an auxiliary hub device for temporarily interconnecting a drive shaft and outboard propeller should be adaptable for use with a variety of specific propeller configurations. By this it is meant that it would be desirable if the temporarily interconnecting member could be used with either left or right-handed propellers.

Such a device would not only be extremely convenient, but also would perform a significant safety function. Today, if a propeller begins to freewheel about its drive shaft, the boat and its occupants is simply cast adrift. Should a change in weather bring storm conditions, the disabled boat could easily be capsized. It is, therefore, contemplated that an auxiliary hub such as that of the present invention would be as important to a boat owner as is his life preserver. Using such an auxiliary hub device, the boat could return to port under its own power, although, admittedly, at a somewhat reduced speed.

SUMMARY OF THE INVENTION

The present invention relates to an auxiliary hub device for use in combination with the propeller of an outboard drive marine engine. By virtue of the construction of the auxiliary hub device, it can be disposed in operative, interlocking relation between the engine's drive shaft and the outboard propeller. The device is specifically intended for use in situations where the propeller has sheared or broken loose from its drive shaft, thereby disabling the boat.

In a preferred embodiment of the invention, the auxiliary hub device comprises sleeve means formed from a substantially cylindrical section of a tubular metal material. The inside diameter of the sleeve is such that it will slidingly engage the outside of the propeller hub. Blade notches corresponding to the propeller blades are formed in one end of the sleeve so as to receive the blades therein when the sleeve is slipped around the propeller hub. The configuration of the blade notches is such that one edge of each notch engages a corresponding blade of the propeller.

Having thus slipped the auxiliary hub onto the propeller, the hub is mechanically fastened to the engine's drive shaft. In the preferred embodiment, this mechanical attachment is accomplished by passing a bolt through one side of the sleeve, through a corresponding passageway formed in the drive shaft and out the other side of the sleeve. By virtue of this mechanical attachment, power from the drive shaft is transmitted directly through the auxiliary hub to each of the blades of the propeller, causing the propeller to turn. Auxiliary fastening means are provided in order to insure a more positive engagement of the auxiliary hub to the propeller. These auxiliary fastening means comprise a plurality of threaded apertures having corresponding set screws placed therein. The set screws are tightened down and abuttingly engage corresponding portions of the propeller itself.

The embodiment described above is intended for use in combination with outboard marine engines wherein a portion of the drive shaft is accessible aft of the propeller itself. For example, this type construction is utilized in OMC brand engines. It should also be noted that by virtue of the abutting relation between one edge of the blade notches and a corresponding one of the propeller blades, the notches must be configured to receive either left or right-handed propeller pitches. The sleeve means of the present embodiment could be constructed to include left-hand blade notches on one end and right-hand notches at the other end. If so constructed, a single hub could be used on either left or right-handed propellers.

A second preferred embodiment has also been developed. This embodiment differs from that described above only in the means for attaching the auxiliary hub to the engine's drive shaft. This second preferred embodiment is necessary because certain manufacturers, such as Mercury brand outboard motors, do not provide a portion of the drive shaft extending aft of the propeller. In this second embodiment the lock means of the invention for mechanically connecting the auxiliary hub to the drive shaft comprises an annular shoulder extending inwardly toward the axis of the sleeve. A second cylinder is formed on the interior periphery of the annular shoulder and extends in substantially concentric relation to the outside of the sleeve toward the blade notches on the other end of the sleeve. An annular plate is formed at the bottom of the second cylinder and defines a plane substantially parallel to that of the annular shoulder. The aperture defined by this annular plate is dimensioned and configured to receive the engine's drive shaft therethrough. Thus, when the auxiliary hub is slipped around the propeller hub the drive shaft extends through the aperture defined by the annular plate. Fastening means generally comprising a drive shaft nut is then mounted on the drive shaft in interconnecting relation between the drive shaft and the annular plate of the auxiliary hub. As above with specific regard to the first preferred embodiment, auxiliary fastening or lock means are also provided in this second embodiment.

The invention accordingly comprises an article of manufacture possessing the features, properties and the relation of elements which will be exemplified in the articles hereinafter described, and the scope of the invention will be indicated in the claims.

BRIEF DESCRIPTION OF THE DRAWINGS

For a fuller understanding of the nature and objects of the invention, reference should be had to the following detailed description taken in connection with the accompanying drawings, which.

Similar reference characters refer to similar parts throughout the several views of the drawings.

DETAILED DESCRIPTION

Figure 1:
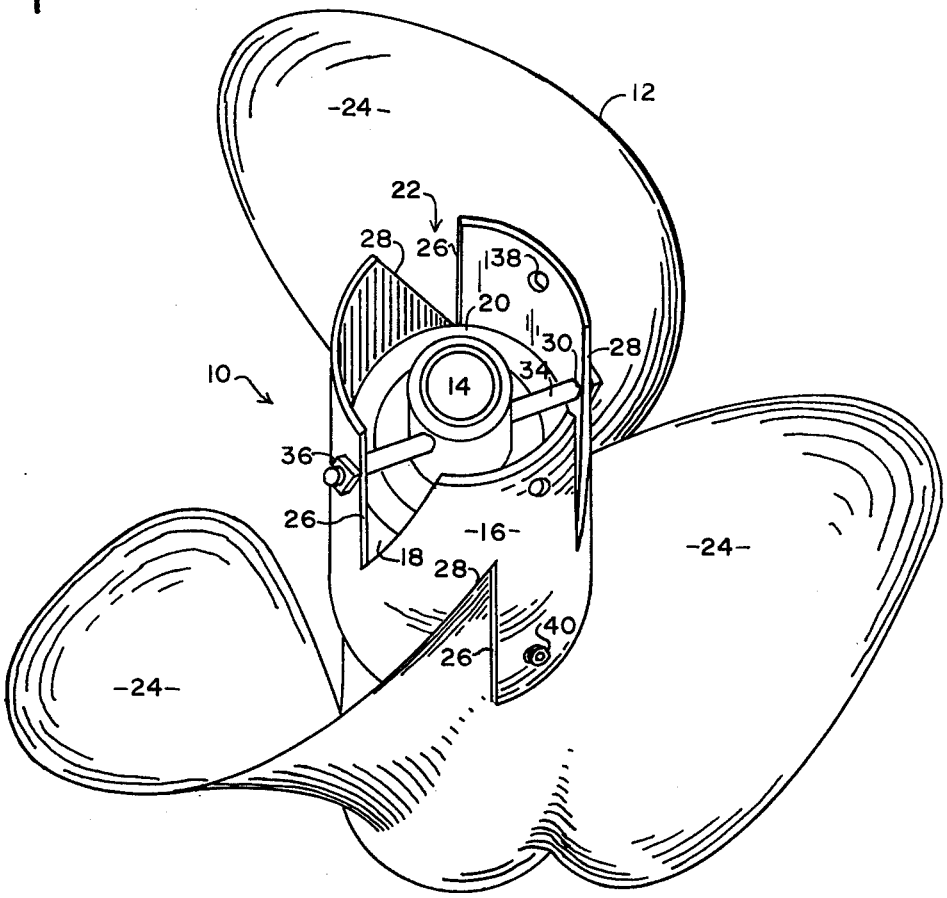
FIG. 1 is a perspective view of a preferred embodiment of the invention operatively installed on an outboard propeller.

A preferred embodiment of the auxiliary hub device of the present invention is shown in the view of FIG. 1, and is generally indicated as 10. As shown in FIG. 1, auxiliary hub device 10 is operatively mounted on propeller 12 of an outboard drive marine engine. More specifically, and as will be described in greater detail below, hub 10 is operatively disposed between propeller 12 and drive shaft 14.

Auxiliary hub device 10 basically comprises a sleeve means 16 formed from a substantially cylindrical material and having an inside diameter such that sleeve means 16 will slidingly engage outside 18 of propeller hub 20. Blade notches generally indicated as 22 are formed in at least one end of sleeve 16 in corresponding relation to propeller blades 24 to receive a corresponding one of blades 24 in each of said blade notches 22 when sleeve 16 is slipped around hub 20.

At this point it should be noted that each of the blade notches 22 is defined by an intersecting first edge 26 and second edge 28. Each of the first edges 26 is substantially parallel to the longitudinal axis of sleeve means 16, and second edges 28 are angularly oriented with respect to first edge 26. By virtue of this construction, a first edge 26 will abuttingly engage a corresponding one of the propeller blades 24. Of course, as illustrated in the view of FIG. 1, it may be desirable to reverse the relative orientation for first edges 26 and second edges 28 on opposite ends of sleeve 16 so as to provide a hub device 10 which can be used on either right-handed or left-handed propellers. For example, in the view of FIG. 1, hub 10 is illustrated in operative placement on a right-handed or clockwise, propeller 12. If hub 10 were reversed, blade notches 22 would then be configured for operative engagement with a left-handed or counterclockwise propeller.

Having thus far generally described the construction of the preferred embodiment of the hub device 10, attention is now invited to the following description of the device's lock means, whereby device 10 may be secured to propeller drive shaft 14 in locking, interconnecting relation between drive shaft 14 and propeller 12.

The lock means of the preferred embodiment of the present invention comprises a pair of oppositely disposed apertures 30 formed in sleeve means 16 in axial alignment with a corresponding passageway 32 extending diametrically through propeller drive shaft 14. Fastening means comprising nut 34 and bolt 36 and are then utilized to secure sleeve 16 to drive shaft 14. As stated above, operative engagement between sleeve 16 and propeller 12 is accomplished by virtue of the abutting relationship between each of the first edges 26 of blade notches 22 with a corresponding one of the propeller blades 24. Auxiliary lock means comprising a plurality of threaded apertures 38 may be provided for the purpose of obtaining a more stable engagement of sleeve 16 with outside 18 of propeller hub 20. As shown in the view of FIG. 1, threaded apertures 38 are formed in sleeve 16 in alternating relation to blade notches 22. Threaded second bolts 40 are screwed into apertures 38, whereby one end of second bolts 40 will abuttingly engage that portion of propeller hub outside 18 behind each aperture 38.

By virtue of this construction, a virtual 3-part locking engagement is accomplished. First, sleeve 16 is fixedly attached to drive shaft 14 by bolt 34 and nut 36. Second, sleeve 16 operatively engages propeller 12 at each of the blade notches 22. Finally, in order to insure a positive, relatively vibration-free attachment of device 10 to propeller 12, threaded bolts 40 are inserted into apertures 38 to abuttingly engage outside 18 of propeller hub 20.

Figure 2:
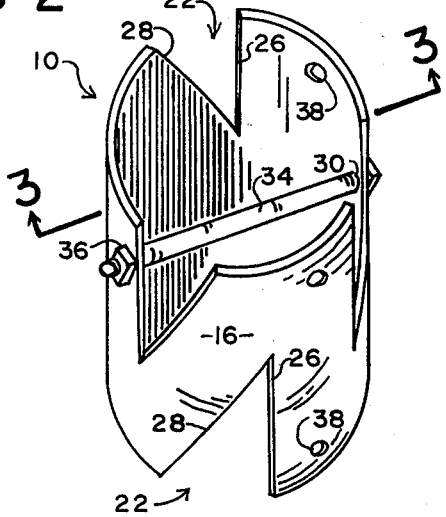
FIG. 2 is a perspective view of the preferred embodiment of FIG. 1.
Figure 3:
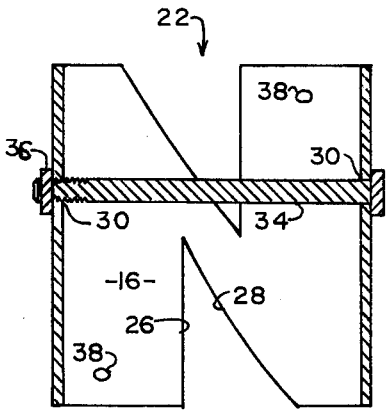
FIG. 3 is a sectional view taken along line 3—3 of FIG. 2.

It should be pointed out that while the auxiliary hub device 10 thus far described will allow transfer of power from drive shaft 14 to propeller 12, it is not intended that device 10 will allow the marine craft to operate at full speed or efficiency. Auxiliary hub device 10 is specifically designed and constructed as a safety feature whereby, through its use, an otherwise disabled craft will be able to return to the safety of its harbor. Finally, it must be remembered that the preferred embodiment of FIGS. 1–3 is shown with specific regard to that type outboard marine engine wherein a portion of the drive shaft is directly accessible aft of the propeller itself. Of course, all outboard drive marine engines are not so constructed. Accordingly, attention is now invited to the second embodiment illustrated in the views of FIGS. 4–6.

Figure 4:
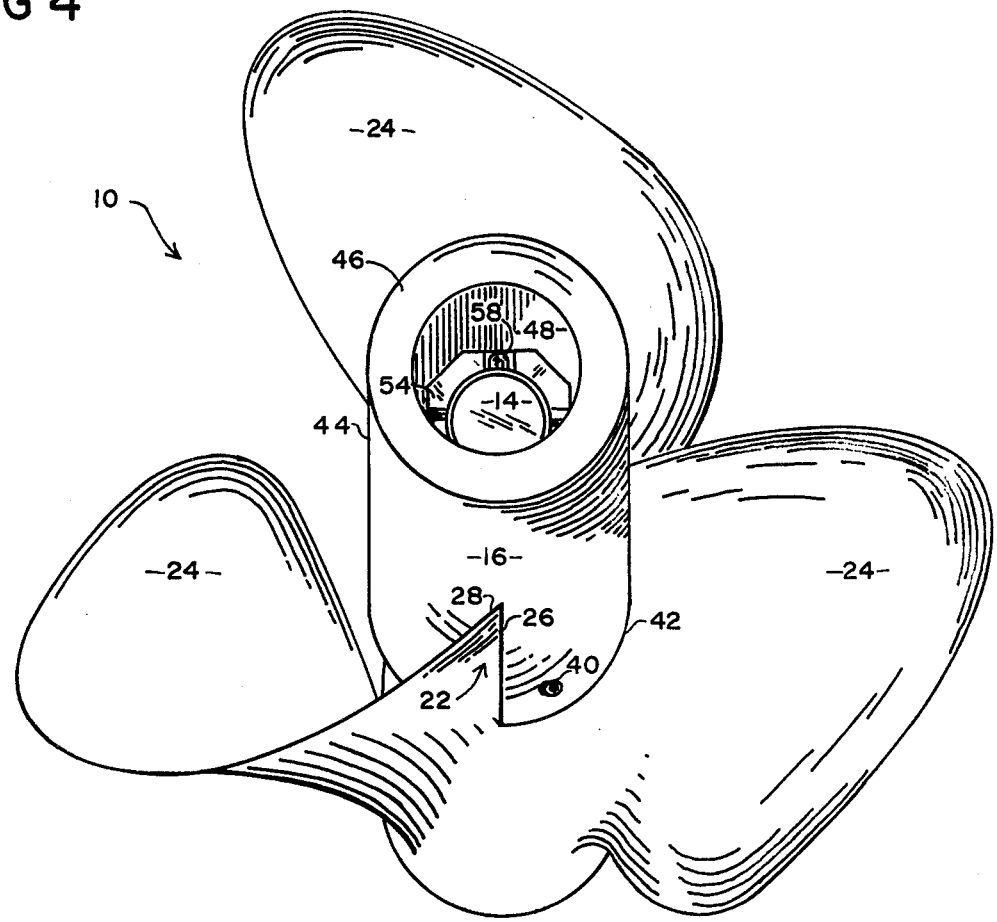
FIG. 4 is a perspective view of an alternate embodiment of the invention operatively installed on an outboard propeller.

As best seen in the view of FIG. 4, the second embodiment of auxiliary hub device 10 differs from that shown in FIG. 1 in the precise construction of the lock means. This difference is due to the fact that the second embodiment of FIG. 4 is intended for use in those outboard motors wherein a portion of the drive shaft does not extend sufficiently aft of the propeller to allow attaching hub 10 with the lock means described above. For example, Mercury brand outboard motors are generally constructed in accord with the view of FIG. 4. In any event, certain structural features of the second embodiment are identical to those previously discussed. These structural features have been identified with reference numerals corresponding to those prevously given.

Figure 5:
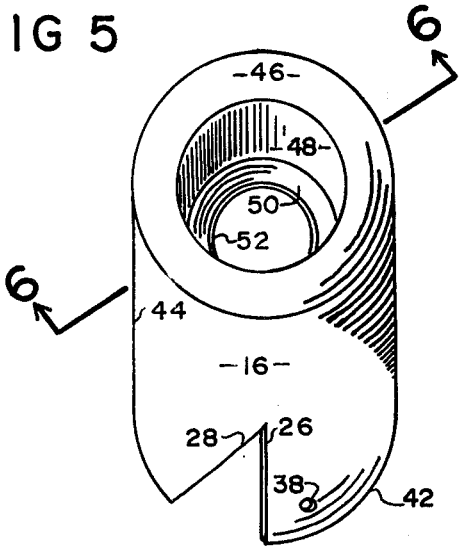
FIG. 5 is a perspective view of the alternate embodiment of FIG. 4.
Figure 6:
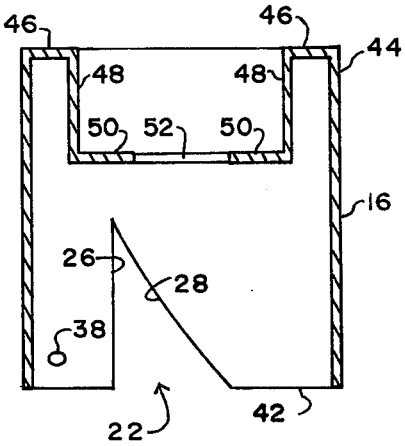
FIG. 6 is a sectional view taken along line 6—6 of FIG. 5.

As illustrated in FIG. 4, only one end 42 of sleeve means 16 includes blade notches 22 formed therein. Opposite end 44 of sleeve 16 is structurally modified to provide the lock means of the second embodiment. The lock means comprises an annular shoulder 46 formed on opposite end 44 and extending inwardly toward the axis of sleeve 16. A second cylinder 48 is integrally formed on the interior periphery of annular shoulder 46 and extends in substantially concentric relation to the first cylinder comprising sleeve 16 in the direction of blade notches 22. Next, an annular plate 50, best seen in the views of FIGS. 5 & 6, is formed around the bottom of second cylinder 48 to define a plane substantially parallel to that of annular shoulder 46. A drive shaft aperture 52 is defined by annular plate 50 and is dimensioned and configured to receive drive shaft 14 therethrough. Finally, fastening means comprising drive shaft nut 54 is threaded onto drive shaft 14, thereby abutting annular plate 50 and operatively attaching hub device 10 to drive shaft 14. As shown in FIG. 4, Drive shaft nut 54 may be notched as at 56, and drive shaft 14 may have a passageway (not shown) formed therethrough for the insertion of a nut lock 58.

Here, then, in the second embodiment the same 3-part engagement of auxiliary hub 10 with propeller 12 and drive shaft 14 is provided as was discussed with regard to the first preferred embodiment. Hub 10 is locked to drive shaft 14 by virtue of the cooperation between drive shaft nut 54 and its abutting relationship to annular plate 50. Hub 10 operatively engages propeller blades 24 along each of the first edges 26 of blade notches 22. Finally, auxiliary attachment of hub 10 is provided by threaded apertures 38 and threaded second bolts 40 inserted therein. By virtue of the lock means of this second embodiment it should be obvious that separate auxiliary hub devices are required for left and right-handed propellers. The view of FIG. 4 illustrates an auxiliary hub device 10 for use in combination with a right-handed, or clockwise, propeller. Should use with a left-handed, or counterclockwise, propeller be desired, it would be necessary to provide an auxiliary hub device 10 wherein the orientation of first edges 26 and second edges 28 was reversed.

It will thus be seen that the objects set forth above, among those made apparent in the preceding description, are efficiently attained, and since certain changes may be made in the above article without departing from the scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described,

What is claimed is:

1. An auxiliary hub device for use in combination with the propeller of an outboard drive marine engine, said auxiliary hub device comprising: sleeve means configured and dimensioned for sliding engagement with the hub of said propeller; a plurality of blade notches formed in said sleeve means on at least one end defining the periphery thereof, each of said notches being configured and dimensioned to receive a corresponding one of the blades of said propeller therein; and lock means operatively disposed on the end of said sleeve means opposite from said blade notches, whereby said auxiliary hub device may be secured to the propeller drive shaft in locking, interconnecting relation between said drive shaft and said propeller.

2. An auxiliary hub device as in claim 1 wherein said sleeve means comprises a cylinder, the inside diameter of said cylinder being substantially equal to the outside diameter of said propeller hub.

3. An auxiliary hub device as in claim 1 wherein said lock means comprises a pair of oppositely disposed apertures formed in said opposite end, said apertures being axially aligned with a corresponding passageway extending diametrically through said propeller drive shaft, and fastening means dimensioned and configured for extending through said apertures and said passageway, whereby said sleeve means is attachable to said drive shaft in driven relation thereto.

4. An auxiliary hub device as in claim 3 wherein said fastening means comprises a nut and bolt.

5. An auxiliary hub device as in claim 1 further comprising auxiliary lock means comprising a plurality of threaded apertures formed in said notched end of said sleeve means and a corresponding plurality of threaded second bolt means insertable in said threaded apertures, whereby one end of said second bolt means will abuttingly engage a predetermined portion of said propeller hub adjacent said threaded apertures when said second bolt means are screwed into said threaded apertures.

6. An auxiliary hub device as in claim 1 wherein each of said blade notches is defined by intersecting first and second edges, said first edge being substantially parallel to the longitudinal axis of said sleeve means, and said second edge being angularly oriented with respect thereto, whereby said first edge engages said corresponding one of said propeller blades in driving relation thereto.

7. An auxiliary hub device as in claim 1 further comprising a plurality of said blade notches formed on said sleeve means on each of said ends defining the periphery thereof; and said lock means being operatively disposed on each of said sleeve means ends.

8. An auxiliary hub device as in claim 7 wherein said blade notches formed on one of said ends are dimensioned and configured to receive right-handed propeller blades, and said blade notches formed on the other of said ends are dimensioned and configured to receive left-handed propeller blades.

9. An auxiliary hub device as in claim 1 wherein said sleeve means comprises a first cylinder and said lock means comprises an annular shoulder extending inwardly toward the axis of said first cylinder; a second cylinder formed on the interior periphery of said annular shoulder and extending in substantially concentric relation to said first cylinder toward said blade notches; an annular plate formed at the bottom of said second cylinder, said annular plate defining a plane substantially parallel to that of said annular shoulder, wherein the aperture defined by said annular plate is dimensioned and configured to receive said drive shaft therethrough; and fastening means mountable on said drive shaft in interconnecting relation between said drive shaft and said annular plate, whereby said sleeve means is attachable to said drive shaft in driven relation thereto.

10. An auxiliary hub device as in claim 9 wherein said fastening means comprises a drive shaft nut.

* * * * *